US010654080B2

(12) United States Patent
Soni

(10) Patent No.: US 10,654,080 B2
(45) Date of Patent: May 19, 2020

(54) DEVICE AND METHOD FOR MATERIAL REMOVAL

(71) Applicant: Juhi Soni, Des Plaines, IL (US)

(72) Inventor: Juhi Soni, Des Plaines, IL (US)

( * ) Notice: Subject to any disclaimer, the term of this patent is extended or adjusted under 35 U.S.C. 154(b) by 157 days.

(21) Appl. No.: 14/934,581

(22) Filed: Nov. 6, 2015

(65) Prior Publication Data

US 2017/0128990 A1 May 11, 2017

(51) Int. Cl.

| | |
|---|---|
| ***B08B 9/087*** | (2006.01) |
| ***B05B 11/00*** | (2006.01) |
| ***B05B 15/00*** | (2018.01) |
| ***B05B 15/30*** | (2018.01) |
| ***A45D 40/00*** | (2006.01) |

(52) U.S. Cl.

CPC ..... *B08B 9/087* (2013.01); *A45D 40/00* (2013.01); *B05B 15/30* (2018.02); *B05B 11/3001* (2013.01)

(58) Field of Classification Search

CPC ..... B08B 9/087; B08B 9/0808; B08B 1/005; B08B 9/38; B05B 11/0089; B05B 11/3001; B05B 11/3047; B05B 15/005; B05B 15/30; A47L 13/02; A47L 13/08; A47L 17/06; A47F 13/08; A01B 1/02

USPC ..... 294/176; 15/236.01, 236.05, 15/236.07–236.09, 245, 245.1; 222/464.1, 464.3, 464.4, 464.7

See application file for complete search history.

(56) References Cited

U.S. PATENT DOCUMENTS

| | | | | | |
|---|---|---|---|---|---|
| 94,094 | A * | 8/1869 | Fagan | A01B 1/02 | 294/176 |
| 356,344 | A * | 1/1887 | Bardell | B25G 1/00 | 279/104 |
| 745,678 | A * | 12/1903 | Schulze | A47L 13/08 | 15/236.05 |
| 1,249,529 | A * | 12/1917 | Smith | B23B 31/1179 | 15/145 |
| 5,345,642 | A * | 9/1994 | Faldetta | A47L 13/08 | 15/105 |
| 5,799,997 | A * | 9/1998 | Lehn | A47L 13/022 | 15/236.07 |
| 5,953,785 | A * | 9/1999 | Malmborg | A47J 43/28 | 15/121 |
| 9,775,271 | B2 * | 10/2017 | Bartnik | A01B 1/022 | |
| 9,878,438 | B2 * | 1/2018 | Mackin | B25G 3/10 | |
| 2012/0280525 | A1 * | 11/2012 | Tharp | A47J 43/28 | 294/176 |
| 2014/0319182 | A1 * | 10/2014 | Anzalone | B05B 11/3042 | 222/382 |
| 2015/0250361 | A1 * | 9/2015 | Marion | A45D 40/00 | 15/105 |
| 2017/0008038 | A1 * | 1/2017 | Bruney | B25G 1/04 | |
| 2018/0099402 | A1 * | 4/2018 | Mackin | B25G 3/10 | |

FOREIGN PATENT DOCUMENTS

| | | | | |
|---|---|---|---|---|
| FR | 2912671 A1 * | 8/2008 | ..... | A45D 34/00 |

* cited by examiner

*Primary Examiner* — Dean J Kramer
(74) *Attorney, Agent, or Firm* — Nixon Peabody LLP

(57) ABSTRACT

A device is provided for removing material from a container. The device includes a scoop and a connector. The scoop extends distally from a shoulder portion. The connector extends proximally from the shoulder portion and couples the device to a tube within the container.

6 Claims, 11 Drawing Sheets

DEVICE AND METHOD FOR MATERIAL REMOVAL

TECHNICAL HELD

Embodiments of the subject matter disclosed herein relate to devices for removing material from a container, and associated methods.

BACKGROUND

Studies have indicated that from about 15% to about 25% of material within a container is discarded when it is no longer easy to get the material out of the container. Various processes have attempted to remedy this waste. These processes have included cutting open the container, heating the contents, and/or adding water to the contents to pour the contents into another container. However, these processes do not work for all containers, such as for glass containers, and may damage and/or dilute the contents, rendering the contents potentially unusable.

Accordingly, a need exists, therefore, for devices and methods that allow for the removal of material from inside containers.

SUMMARY

According to some aspects of the present disclosure, a device is provided for removing material from a container. The device includes a scoop and a connector. The scoop extends distally from a shoulder portion. The connector extends proximally from the shoulder portion and is configured to couple the device to a tube within the container.

According to further aspects, a device is provided for removing material from a container. The device includes a grip portion for gripping by a user. A shaft extends from the grip portion. A scoop extends from the shaft at an opposite end from the grip portion. A face of the scoop is curved in a first direction relative to an axis defined by a length of the shaft and generally flat in cross section that is transverse to the first direction. A length of the shaft and a length of the scoop are configured so that a distal end of the scoop reaches substantially to bottom corners of the container with the grip portion remaining outside of the container during use.

According to additional aspects, a device is provided for dispensing material from a container. The device includes a pump that is configured to couple to a mouth of the container. A tube connects to the pump and is configured to provide material to the pump. An extractor is coupled to an end of the tube opposite from the pump. The extractor includes a scoop and a connector. The scoop extends distally from a shoulder portion. The connector extends proximally from the shoulder portion and is configured to couple the extractor to the tube.

These and other capabilities of the aspects of the present disclosure will be more fully understood after a review of the following figures, detailed description, and claims.

BRIEF DESCRIPTION OF THE DRAWINGS

Reference is made to the accompanying drawings in which particular embodiments are illustrated as described in more detail in the description below, in which.

Figure 1B:
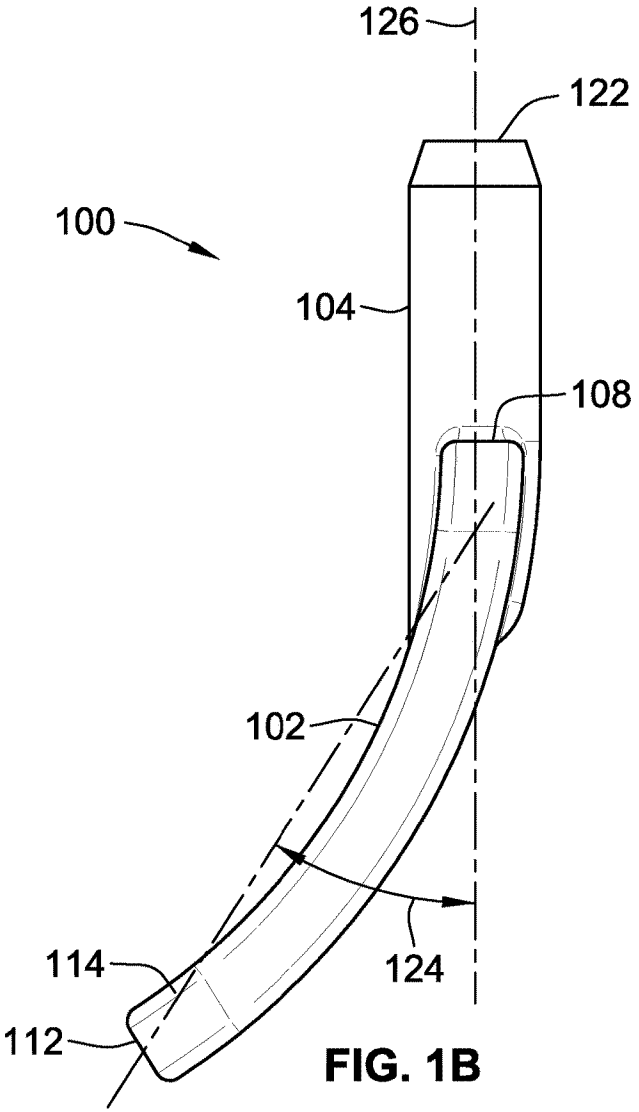
FIG. 1B is a side view of the device in FIG. 1A, in accord with aspects of the present disclosure.
Figure 1A:
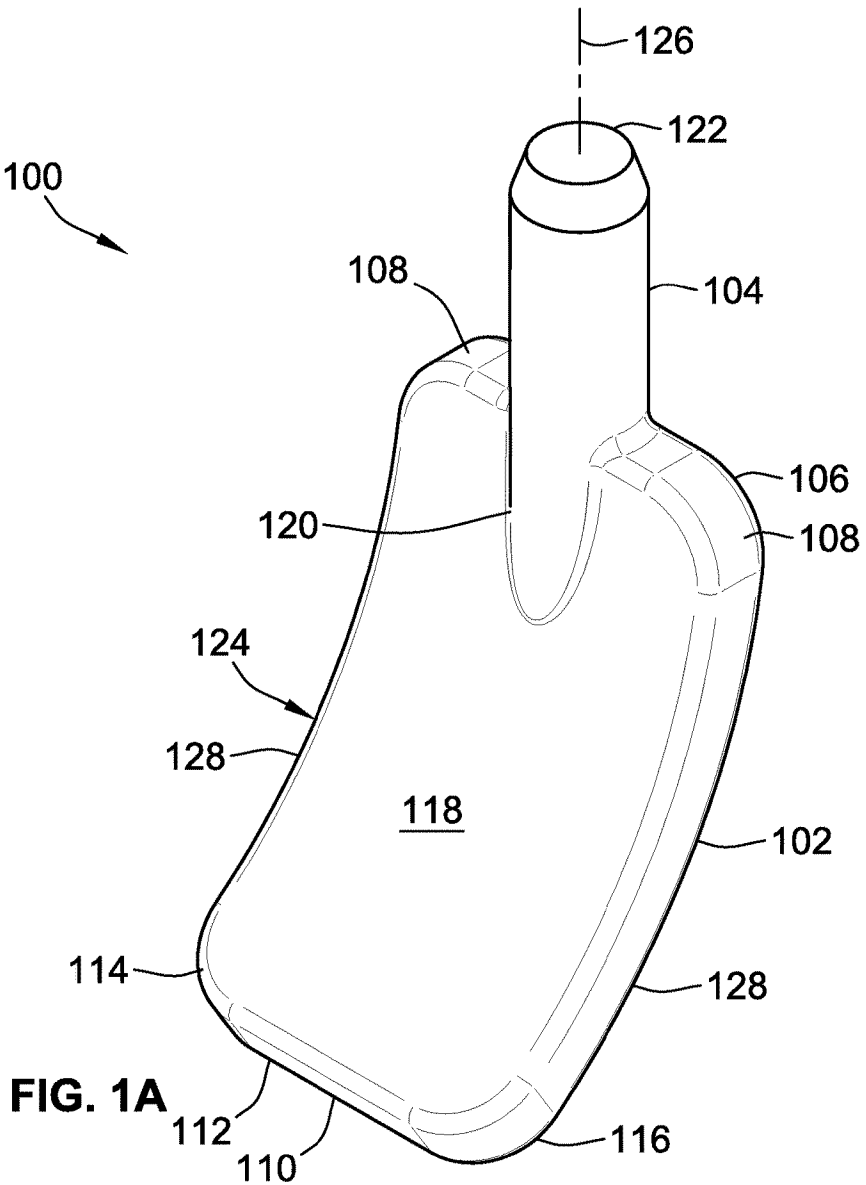
FIG. 1A is a perspective view of a device for removing material from a container, in accord with aspects of the present disclosure.
Figure 1C:
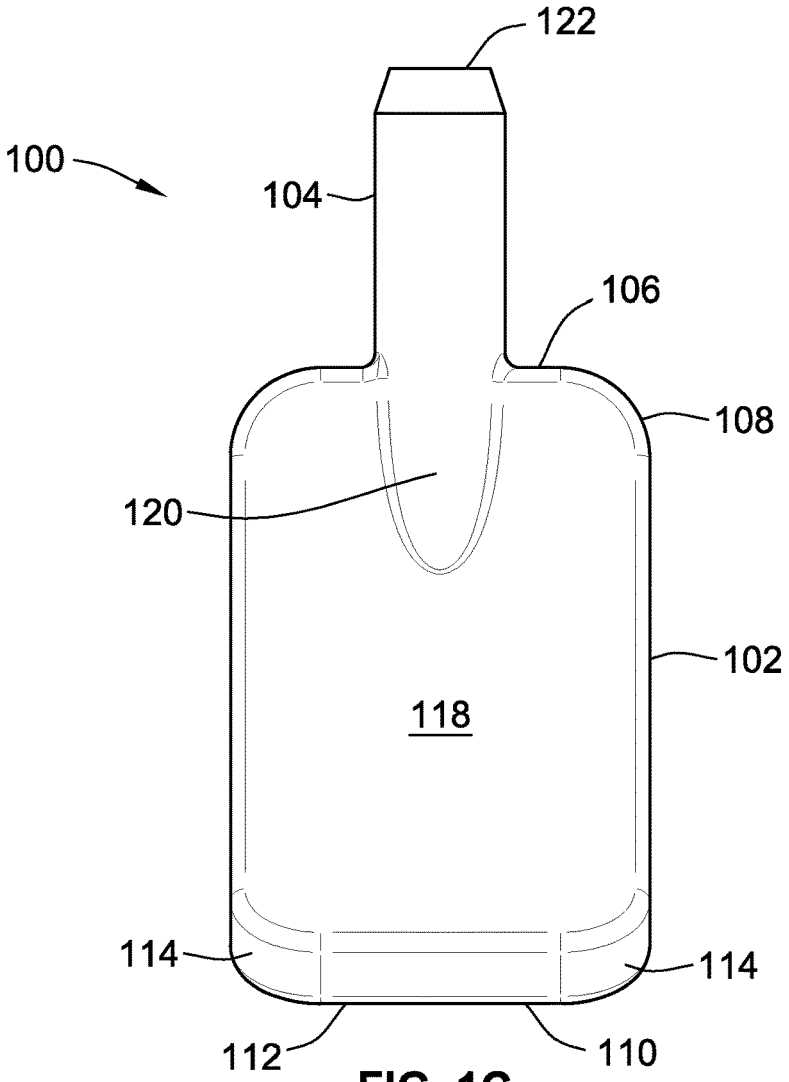
FIG. 1C is a front view of the device in FIG. 1A, in accord with aspects of the present disclosure.
Figure 1D:
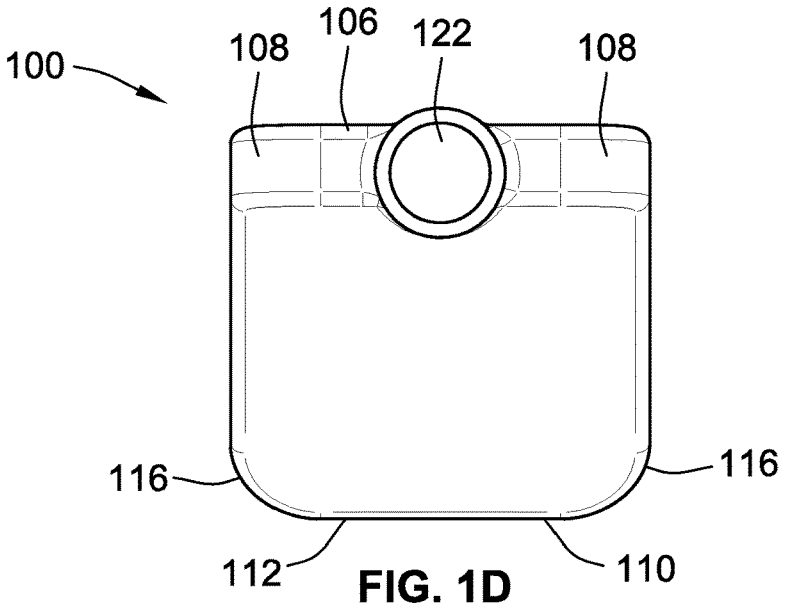
FIG. 1D is a top view of the device in FIG. 1A, in accord with aspects of the present disclosure.
Figure 1E:
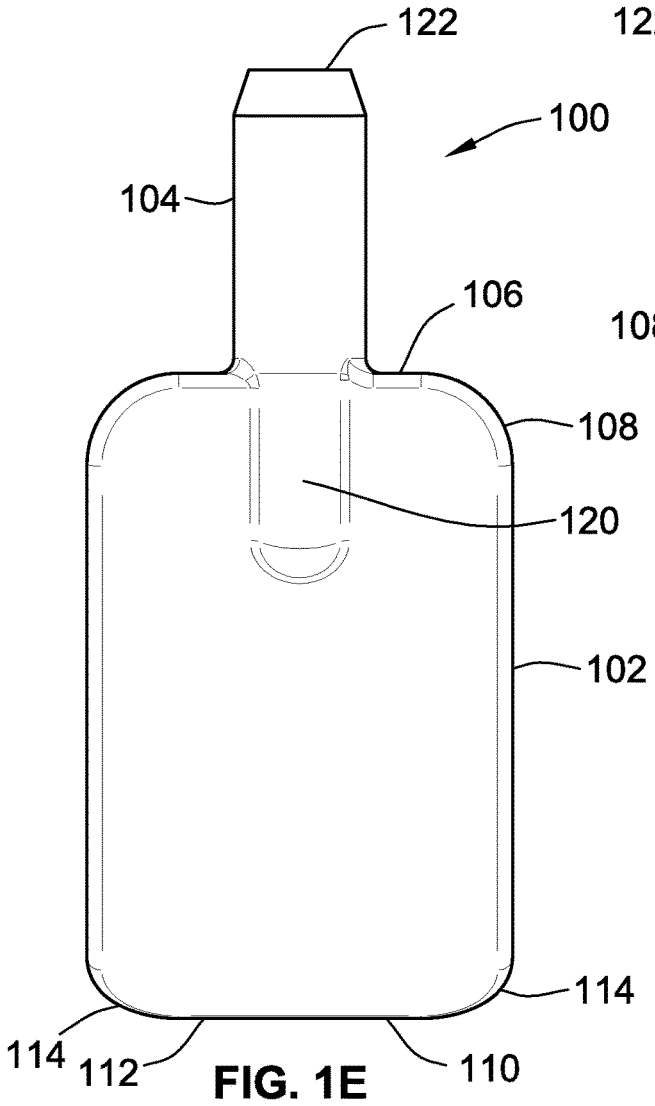
FIG. 1E is a hack view of the device in FIG. 1A, in accord with aspects of the present disclosure.
Figure 1G:
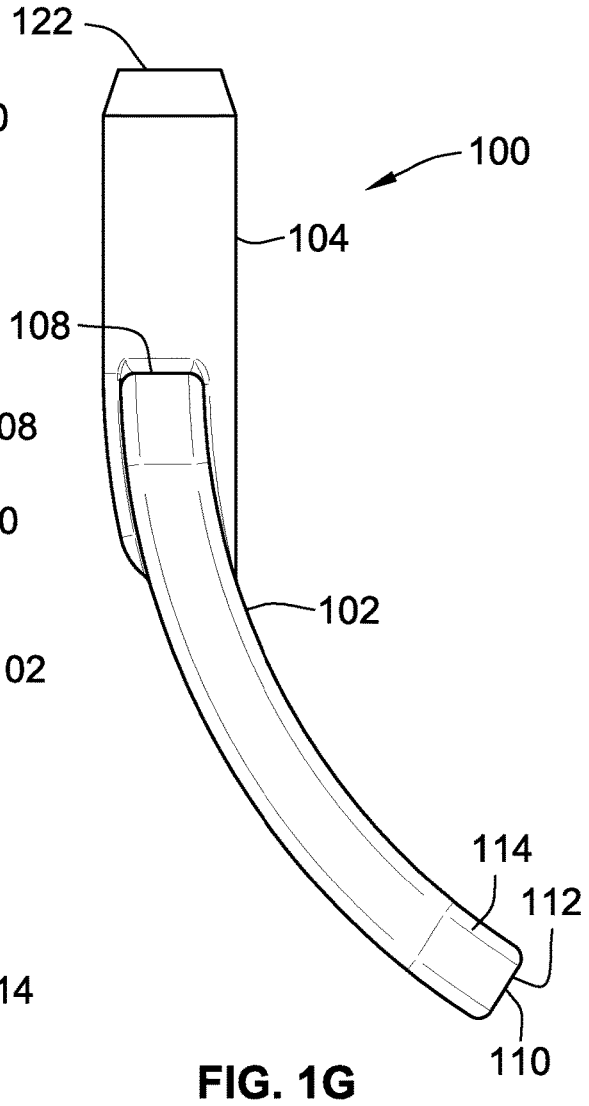
FIG. 1G is a side view of the opposite side in FIG. 1B, in accord with aspects of the present disclosure.
Figure 1F:
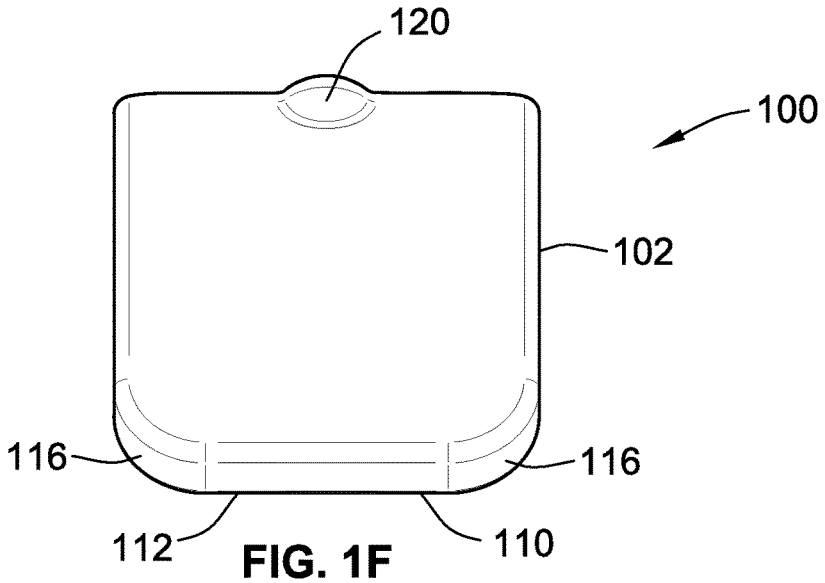
FIG. 1F is a bottom view of the device in FIG. 1A, in accord with aspects of the present disclosure.

While aspects of the present disclosure are susceptible to various modifications and alternative forms, specific embodiments have been shown by way of example in the drawings and will be described in detail herein. It should be understood, however, that the specific embodiments are not intended to be limited to the particular forms disclosed. Rather, the present disclosure covers all modifications, equivalents, and alternatives falling within the spirit and scope of the present disclosure.

DETAILED DESCRIPTION

Devices for removing material from a container, and associated methods, are described herein. In one embodiment, a device is provided for removing material from a container, such as lotion or a gel material. The device includes a scoop extending distally from a shoulder portion; and a connector extending proximally from the shoulder portion, the connector being configured to couple the device to a tube within the container. Further elaboration on the material that can be removed from the container includes the material generally being a semi-fluid material. The semi-fluid material may include one or more of a lotion or a gel, as well as other materials, such as, by way of example, cosmetic and/or personal care materials, including foundations, serums, creams, moisturizers, ointments, and the like. According to some embodiments, the semi-fluid material can include food products, such as, for example, spreadable food products that are dispensed or removed from a container using a device.

With regard to the FIGS. 1A-1G, a device 100 according to aspects of the present disclosure is shown. The device 100 includes a scoop 102 and a connector 104. The connector 104 may be a protuberance that extends away from the scoop 102. However, the connector 104 may be various other shapes as discussed further below, such as a sleeve, a clip, etc. The scoop 102, relative to the connector 104, has a shoulder or proximal portion 106 with shoulders 108. The scoop 102 further includes a distal portion 110 with a distal tip 112, a beveled edge 114, and distal corners 116 that facilitate transitioning to a generally flat tip profile. Although shown with the beveled edge 114, the scoop 102 may include other types of edges, besides beveled, without departing from the spirit and scope of the present disclosure, such as right angles. A scooping surface or face 118 defines a working surface of the scoop 102. A reinforcing section 120 provides a base for the connector 104 and extends into the scoop 102. The connector 104 has a coupling tip 122 that facilitates coupling with, for example, a straw, tube, feed line, and the like (discussed below).

The scoop 102 has an angle 124 where it bends away from an axis 126 defined by a length of the connector 104. In this manner, the scooping surface 118 is curved in at least one direction relative to the axis 126. According to some embodiments, the scooping surface 118 may be curved in two directions relative to the axis 126, such as in a first direction transverse to the axis 126 and a second direction transverse to the axis 126 and the first direction, forming a general shape of a spoon. Although the scoop 102 can be curved in two directions, the distal tip 112 at the distal portion 110 can be curved in only one direction, or straight in both the first direction and the second direction so as to mate with the side surfaces of a container, which may be flat. Alternatively, the distal tip 112 can be curved to match the curvature in the side surfaces of a container so as to prevent or reduce material slipping between the device 100 and the side surfaces of the container during use, as described in greater detail below.

The scoop 102 further includes side edges 128. The side edge 128 can be generally straight, as shown in the figures. Alternatively, the side edges 128 can be rounded or have other geometric shapes, such as oval, triangular, etc. The side edges 128 can further include raised, curled, or elevated portions (not shown) to partially define a volume or a depression within the scooping surface 118 and for aiding in the retention of material on the scooping surface 118.

A linear length of the device 100 as measured along the length of the axis 126 can be for example, about 30 to 50 millimeters (mm), such as 35 mm. A linear length of the reinforcing section 120 measured along the length of the axis 126 can be, for example, about 15 to 25 mm, such as 20 mm. A width of the scoop 102 can be, for example, about 5 to 25 mm, such as 20 mm. A diameter of the connector 104 can be, for example, about 1 to 8 mm, such as 4 mm, although larger diameters can be used for larger containers and/or larger pumps. The thickness of the scoop 102 can be, for example, about 0.5 to 2 mm, such as 1.5 mm. Although specific measurements of the device 100 are provided, such measurements are not meant to be limiting and can vary without departing from the spirit and scope of the present disclosure. For example, the dimensions of the device 100 can vary depending on the size of a container within which the device 100 is to be used to withdraw material. According to some embodiments, all of the provided dimensions may scale in size together. Alternatively, one or more of the dimensions may not scale in size. For example, as the width and/or length of the scoop 102 increases, the diameter of the connector 104 may remain fixed.

The angle 124 shown in the illustrated embodiment is about 25 degrees. However, the angle 124 can vary from 25 degrees without departing from the spirit and scope of the present disclosure. By way of example and without limitation, the angle 124 can be 5 to 80 degrees, preferably 10 to 60 degrees, and more preferably 20 to 30 degrees. The angle 124 allows the scoop 102 to interface with a side of a container (discussed in detail below) while providing the scooping surface 118 with a curved portion to retain and withdraw material from inside of the container. The specific angle 124 may be selected based on the rheology and/or viscosity of the semi-fluid material, the inner contour of the container, the container opening, and/or other application specific parameters. For more viscous materials, particularly if sticky, a relatively shallower angle may be more useful, particularly for withdrawing the device 100 from inside of a container. For less viscous materials, a larger angle may be more useful (as well as curved and/or raised lips or edges, as noted elsewhere herein) for retaining the material on the device 100 during extraction.

The device 100 can be formed of various different materials. According to some embodiments, the scoop 102 is formed of a polymeric material selected to be sufficiently rigid to scoop a portion of material from inside a container. By way of example, and without limitation, such a polymeric material can include silicone, a silicone-based material, polyethylene, polypropylene, and the like. According to some embodiments, particularly with respect to food-based applications, the device 100 can be formed of a food-safe material, such as food-grade silicone. As an alternative to the entire device 100 being formed of a single material, the device 100 may alternatively be formed of two or more materials. By way of example, and without limitation, the scoop 102 may be formed of a polymeric material, such as silicone, and the connector 104 and/or the reinforcing section 120 may be formed of a different material, such as stainless steel. For example, the connector 104 may be formed of a material that aids in coupling the device 100 while also providing a specific rigidity to the device 100, and the scoop 102 may be formed of a different material to aid in the withdrawal of material from inside of a container, such as by being flexible to flex against an inner surface of a container. A sufficiently elastic material may be used for the scoop 102 and/or the device 100 that stretches to accommodate a connection.

With regard to a distal tip 112 of the scoop 102, suitable profiles may be selected based on application specific parameters. By way of example, and without limitation, the distal tip 112 may be flat, rounded, etc. depending on the application specific task for the scoop 102 and depending on, for example, the container within which that the scoop is to be used. According to one embodiment, the distal tip 112 of the scoop 102 may be flat and a plane defined by the flat distal tip 112 may be orthogonal to a plane tangent to the curvature of the scoop 102 at the distal tip 112. The distal tip 112 may have other profiles that are selected based on such application specific parameters as the semi-fluid material's properties, the inner profile of the container, the container opening, and the like. For example, in a rounded container, the distal tip may be rounded to match. Additionally, the distal tip 112 may be curved to form a concave profile relative to the body of the scoop 102.

Figure 2:
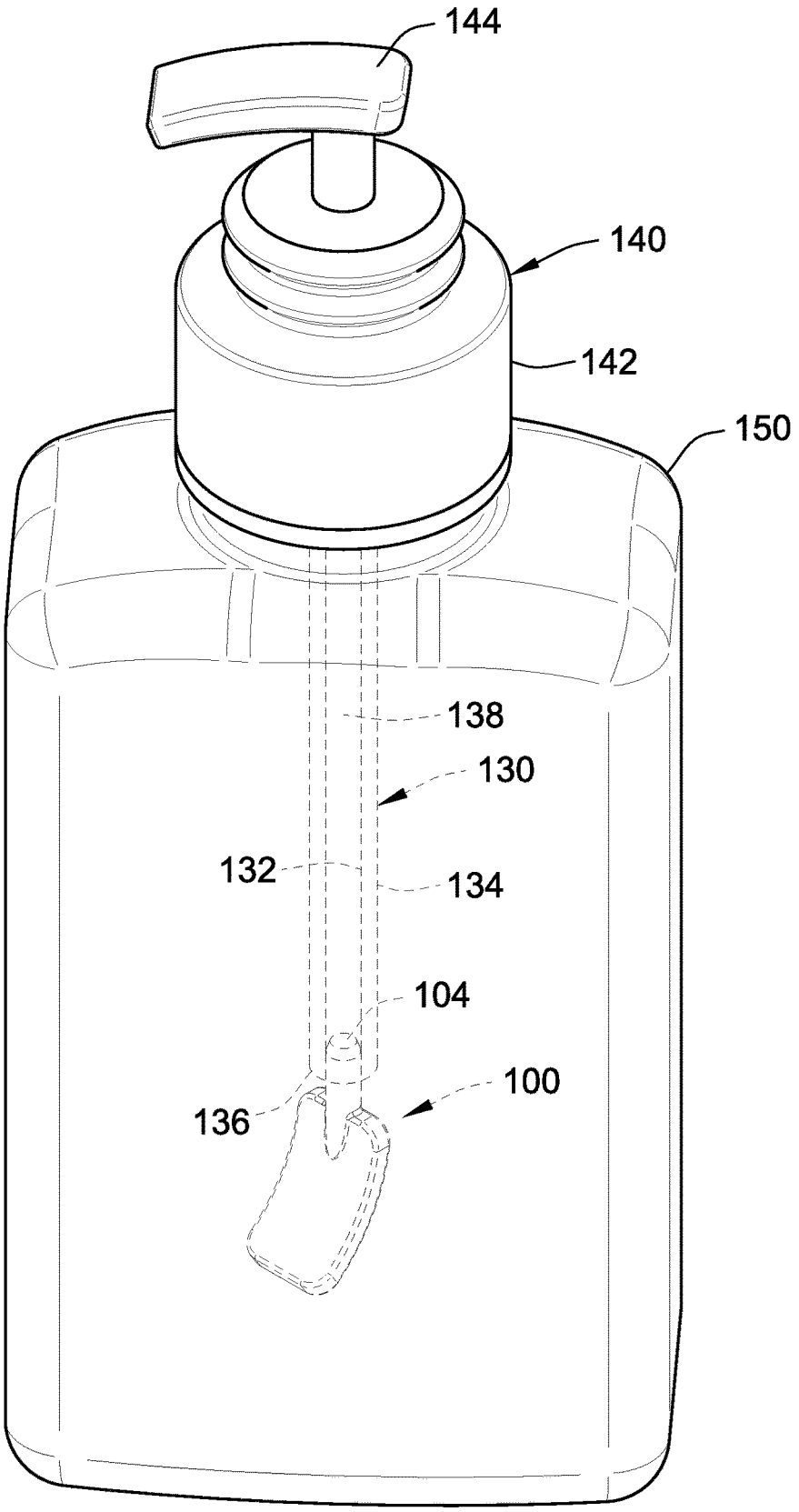
FIG. 2 is a perspective view of a container with an attached device, in accord with aspects of the present disclosure.

FIG. 2 illustrates the device 100 shown in FIGS. 1A-1G coupled to a tube or straw 130. The straw 130 has an inner surface 132, an outer surface 134, and an end 136. The inner surface 132 of the straw 130 at the end 136 defines a channel 138 into which the device 100 is inserted. The straw 130 has another end, not shown, to which a pump 140 may be coupled. The pump 140 has a pump body 142 and a pump handle 144. The pump body 142 couples to a container 150. The container 150 has an opening or aperture (not shown) to which the pump 140 can be coupled and through which the straw 130 (with the device 100) can be inserted into, or withdrawn from, an interior of the container 150. For example, the pump body 142 can couple to the container 150 by way of, for example, a threaded or snap-on aperture on the container 150 that mates with a counter-threaded or snap-on ring in the pump body 142. Thus, the pump 140 may be decoupled from the container 150 so that the device 100 may be attached to the straw 130.

As shown, the connector 104 can fit within the straw 130 and couple the device 100 to the straw 130. During coupling, the connector 104 and the inner surface 132 of the straw 130 couple by way of a pressure fit. However, the connector 104 and the straw 130 can couple according to other approaches, such as a snap fit, etc. In one embodiment, rather than a protuberance, the connector 104 may define a sleeve that is sized and shaped to fit snugly around the outer surface 134 of the straw 130 to couple the device 100 to the straw 130.

The scoop 102 may have a generally flat cross-sectional profile across the scooping surface 118 between the opposite side edges 128 and orthogonal to the axis 126, between the distal tip 112 and the proximal portion 106. As shown, the distal corners 116 between the opposite side edges 128 at the distal tip 112 of the scoop 102 may be curved. The radius of curvature of the distal corners 116 may substantially match a radius of curvature of corners formed between bottom and side surfaces of the container 150, Accordingly, the distal corners 116 of the scoop 102 can remove substantially all of the material at the bottom corners of the container 150 based on the substantially matching profiles of the corners of the container 150 and the distal corners 116.

Figure 3A:
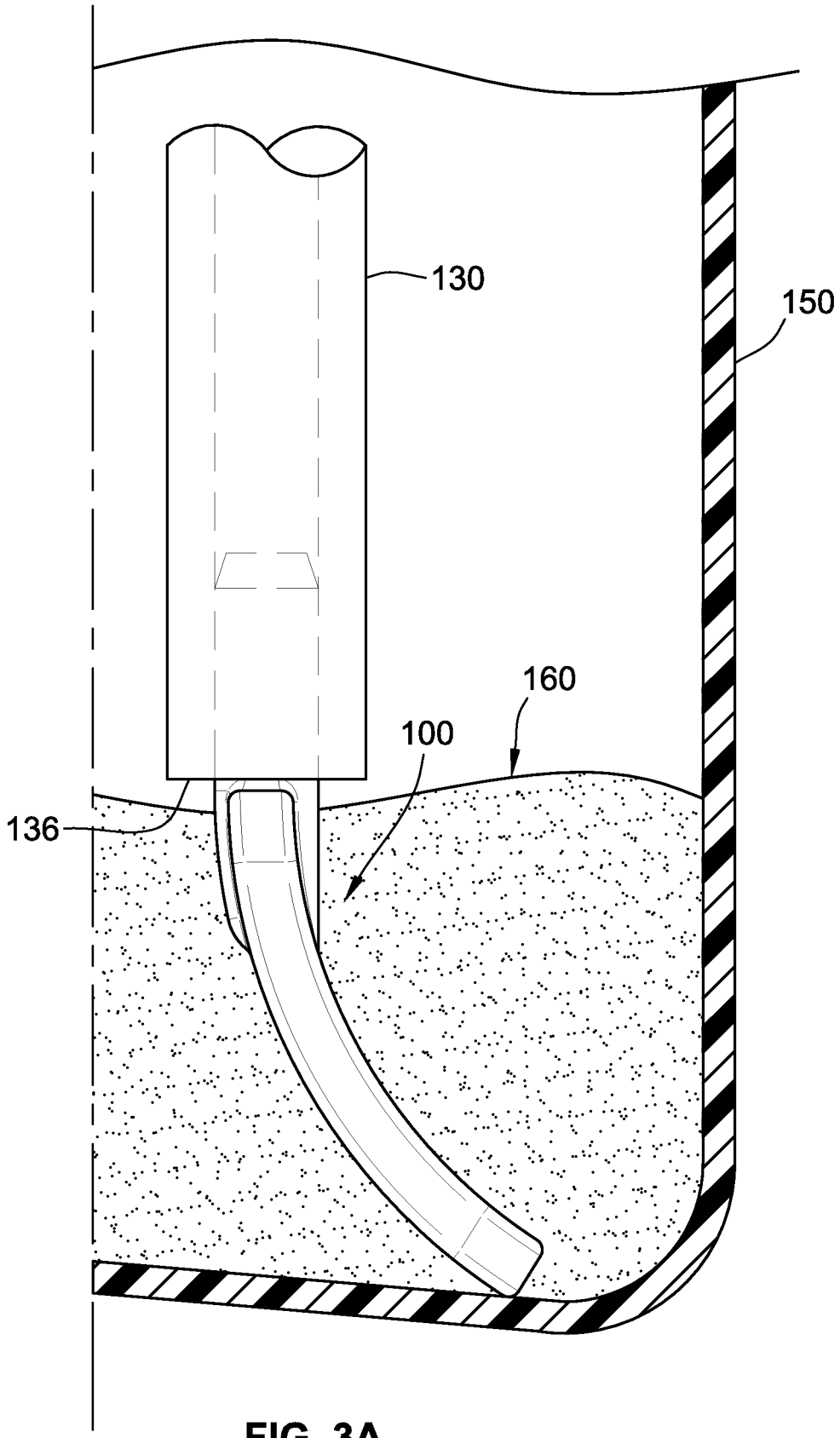
FIG. 3A is a cut-away side view of a device in a first operational position, in accord with aspects of the present disclosure.
Figure 3B:
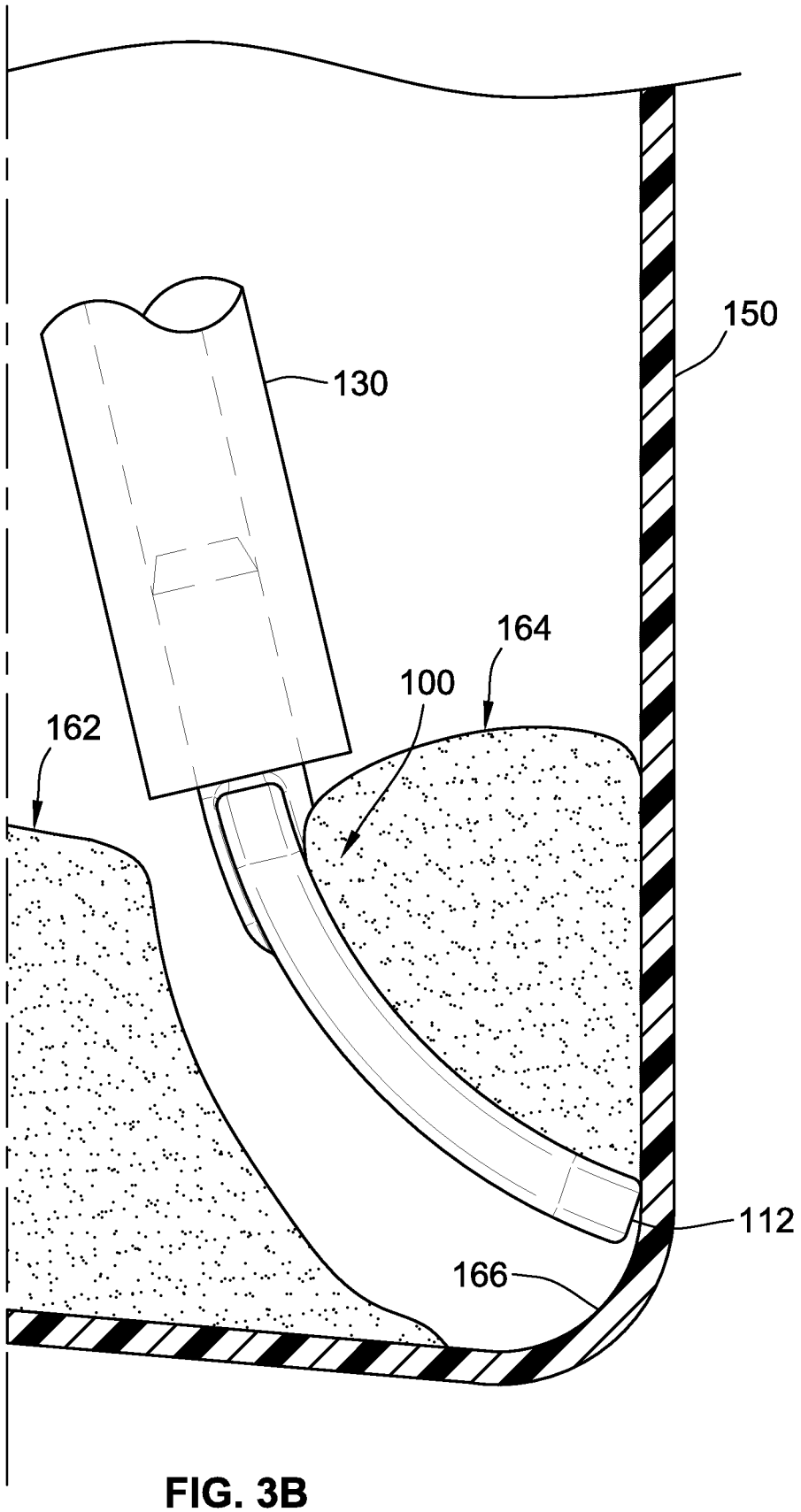
FIG. 3B is a cut-away side view of the device shown in FIG. 3A in a second operational position, in accord with aspects of the present disclosure.
Figure 3C:
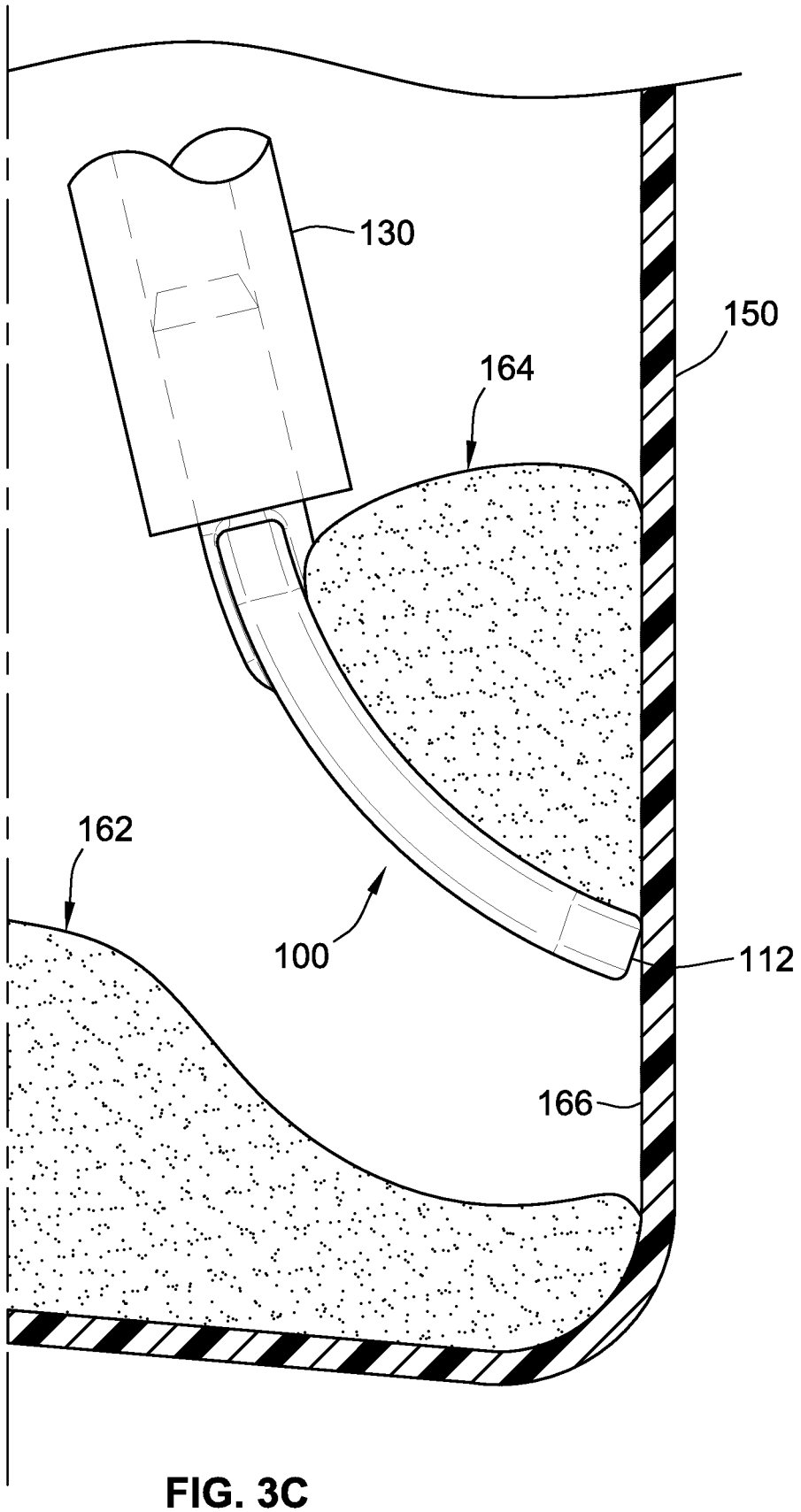
FIG. 3C is a cut-away side view of the device shown in FIG. 3A in a third operational position, in accord with aspects of the present disclosure.

FIGS. 3A-3C show the device of FIGS. 1A-1G in an operational condition during use, in accord with aspects of the present disclosure. By way of example, a scooping operation or operational condition entails, at least in part, the passing of the device 100 through a portion of semi-fluid material in a container so that at least a portion of the semi-fluid material is captured on the scoop 102, and that the scoop 102, with the material, is then withdrawn through the container opening. The container 150 is shown as a cut-away, and a portion of semi-fluid material 160 (e.g., lotion) remains within the container 150. As shown based on the end 136 of the straw 130 being above the top level of the semi-fluid material 160, actuation of the pump 140 no longer withdraws the semi-fluid material 160 from the container because the end 136 of the straw 130 cannot access the semi-fluid material 160. Accordingly, as shown in FIG. 3A, the device 100 is coupled to the straw 130 and is been inserted into the semi-fluid material 160. This may be referred to as a first operational position. By the device 100 being coupled to the straw 130, the device 100 extends beyond the end 136 of the straw and accesses the bottom of the container 150.

In FIG. 3B, the device 100 has been moved into second operational position. In this second operational position, the semi-fluid material 160 has been split into a remainder portion 162 and a scooped portion 164 by use of the device 100. Of note is that the reinforcing section 120 and a rigidity of the scooping surface 118 that facilitate a determined level of flex of the device 100 as the distal tip 112 is urged against an inner surface 166 of the container 150. According to some embodiments, the rigidity of the scoop 102 may be less than the rigidity of the container e.g., container 150) such that the scoop 102 flexes when pressed against the container 150 when normal hand pressure is applied thereto.

In FIG. 3C, the device 100 has been moved into a third operational position. In this third operational position, the device 100 continues to carry the scooped portion 164 up towards, and ultimately through, the opening in the container 150. The distal tip 112 remains biased against the inner surface 166 so that the reinforcing section 120 and the scooping surface 118 provide sufficient flex to scoop the semi-fluid material 160.

As discussed above, the ability of the device 100 to remove the semi-fluid material 160 from the container 150 is based, at least in part, on the angle 124 of the scoop 102 (see FIG. 1B), as shown in FIGS. 3A-3C. The angle 124 allows for the semi-fluid material 160 to be retained by the scoop 102 as the straw 130 with the attached device 100 are removed from the container 150. As the straw 130 and the attached device 100 reach the opening in the container, the angle 124 allows the device 100 to be removed from the inner surface 166 of the container without the semi-fluid material 160 dropping from the scoop 102. Thus, as discussed above, the angle 124 may be greater for less viscous material, such as, for example, greater than 60 degrees. Similarly, the angle 124 may be smaller for more viscous material, such as, for example, less than 30 degrees. In addition, the angle 124 may vary depending on the opening in the container 150, such that, for example, smaller openings may require smaller angles to permit access to the interior of the container 150 with the device 100, while larger openings may allow for larger angles.

Figure 4:
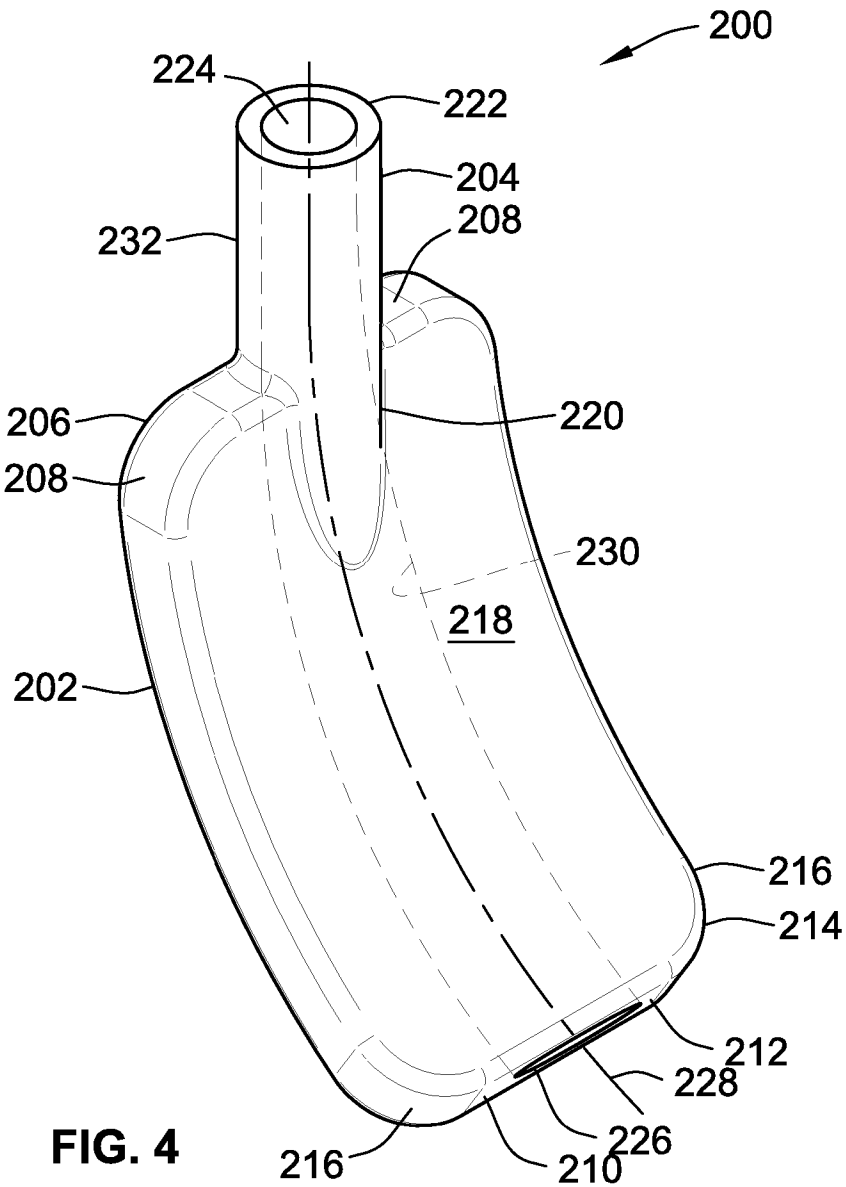
FIG. 4 is a perspective view of an device, in accord with additional aspects of the present disclosure.

Referring to FIG. 4, a device 200 is shown according to additional aspects of the present disclosure. The device 200 is similar to the device 100 discussed above. For example, the device 200 includes a scoop 202 and a connector 204. The scoop 202, relative to the connector 204, has a shoulder or proximal portion 206 with shoulders 208 and a distal portion 210 with a distal tip 212, a beveled edge 214, and distal corners 216 that facilitate transitioning to a generally flat lip profile. A scooping surface or face 218 defines a working surface of the scoop 202. A reinforcing section 220 provides a base for the connector 204 and extends into the scoop 202. The connector 204 has a coupling tip 222 that facilitates coupling with, for example, a straw, tube, feed line, and the like.

In addition, the connector 204 includes an aperture 224 and the distal portion 210 includes an aperture 226. The device 200 further includes a channel 228 indicated by the dashed line that is defined by an inner surface 230 that extends from the aperture 224 in the connector 204 to the aperture 226 in the distal tip 212. The channel 228 permits the distal portion 210 to be in fluid communication with the coupling tip 222.

Figure 5:
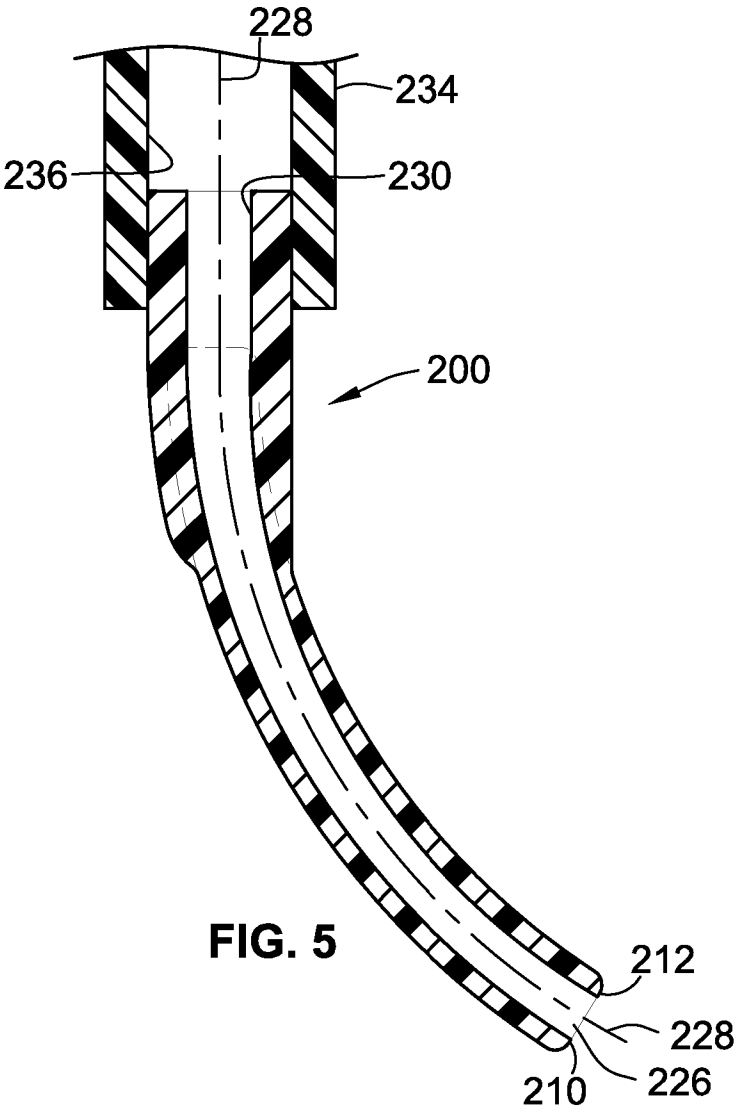
FIG. 5 is a cut-away, side view of the device shown in FIG. 4, in accord with aspects of the present disclosure.

Referring to FIG. 5, a cut-away side view of the device 200 shown in FIG. 4 is provided, in accord with aspects of the present disclosure. An outer surface 232 of the connector 204 is sized and shaped to fit into a straw 234, and to snugly fit against an inner surface 236 of the straw 234, which is connected to a pump (e.g., pump 140). For example, during assembly, the coupling tip 222 may be inserted into the straw 234. After assembly and during use, the device 200 may be inserted into a semi-fluid material (e.g., lotion), the pump 140 may be pumped so as to cause the semi-fluid material to flow through the channel 228, through the straw 234, and then through the pump 140. By the device 200 extending the effective range of the straw 234, by way of the channel 228, the device 200 may allow more semi-fluid material to be pumped from the container 150 as the device 200 extends further into the container 150. Moreover, the device 200 initially may be attached to the straw 234, such as during the manufacturing of the pump 140, without restricting the operation of the pump 140 by blocking access to the straw 130. Thus, the device 200 and the straw 234 may be two separate pieces that are coupled together, such as by a pressure fit, a weld, etc. Alternatively, the device 200 and the straw 234 may be formed as a monolithic, single piece. Naturally, and as described above, the device 200 also may be used to scoop out lotion regardless of the operation of the pump 140.

In alternative embodiments, the aperture 224 in the connector 204 may be large enough to receive the straw 234 into it, rather than the connector 204 being inserted into the straw 234. The channel 228 still continues to flow through the scoop 202 and up into the straw 234. Further, a tapered version of the connector 204 may be used to accommodate different size straws. That is, for the a connector that fits inside the straw, the connector 204 may have a trapezoidal cross-sectional profile such that the deeper the connector 204 is pushed into the straw 234, the larger the outer circumference of the connector 204 becomes. For a connector that fits inside the connector, the inner surface of the connector 204 can be graduated so that the deeper the straw 234 is pushed into the connector 204, the tighter the fit of the connector 204 around the outer surface of the straw 234. While adding some manufacturing complexity, flanges, o-rings, and equivalents may be used to securely couple the connector 204 to the straw 234.

Figure 6:
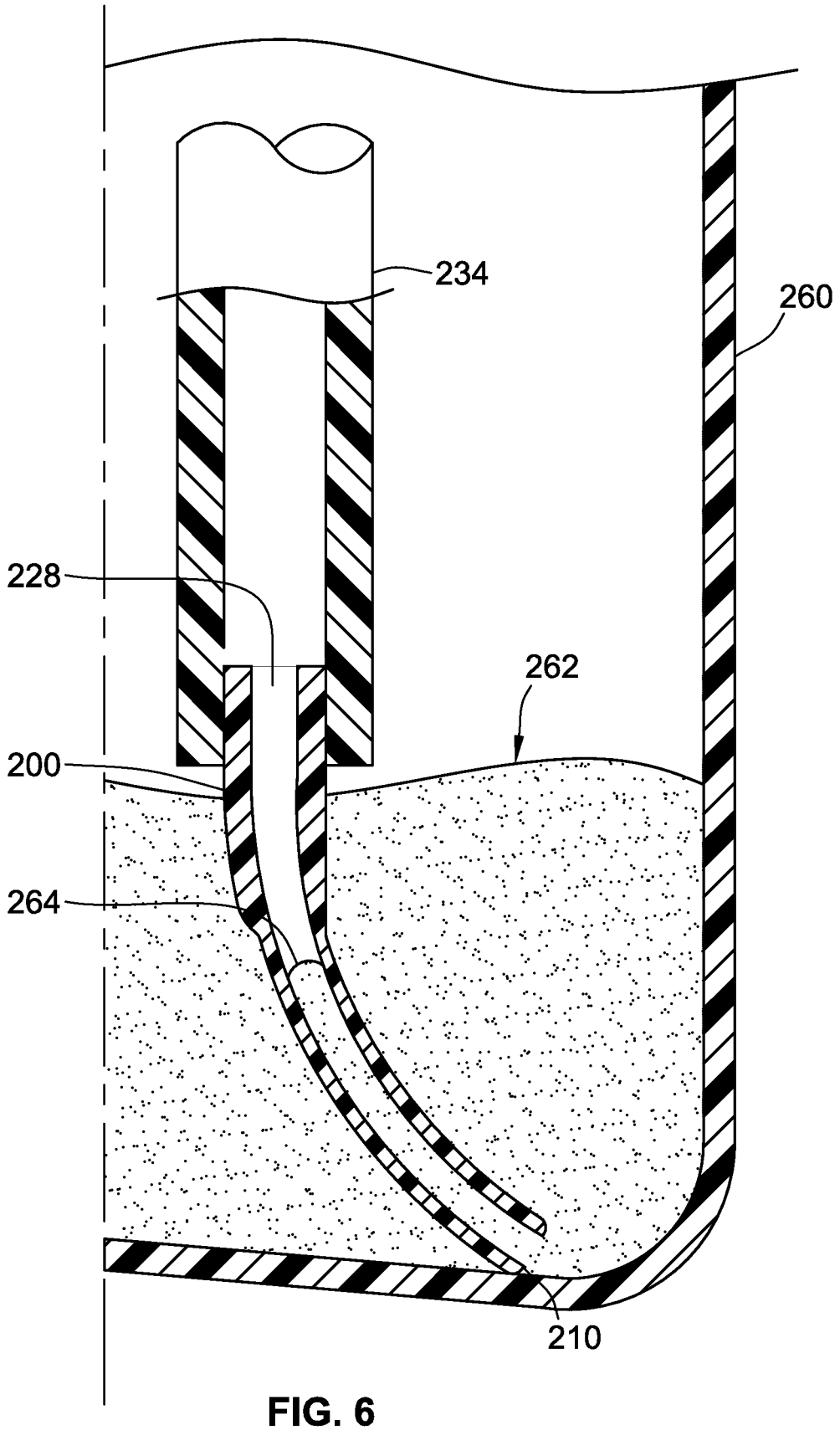
FIG. 6 is a cut-away, side view of the device shown in FIG. 4 in a first operational position, in accord with aspects of the present disclosure.

FIG. 6 is a cross sectional side view of the device 200 of FIG. 4 assembled with the straw 234 and disposed in a container 260 and further disposed into an amount of the semi-fluid material 262 (e.g., lotion). During operation, the pump (not shown) is actuated to pump a portion 264 of the semi-fluid material 262 through the channel 228 and towards the straw 234. Note that the distal portion 210 can be in contact with a bottom inner surface of the container 260, whereas the straw 234 would not extend as far and semi-fluid material at the bottom inner surface of the container 260 otherwise would not be capable of being pumped through the straw 234. With the device 200 coupled to the straw 234, a length of the straw and a length of the device 200 can be configured such that the device 200 can access material in interior extremities of a lower half of the container 260.

Figure 7:
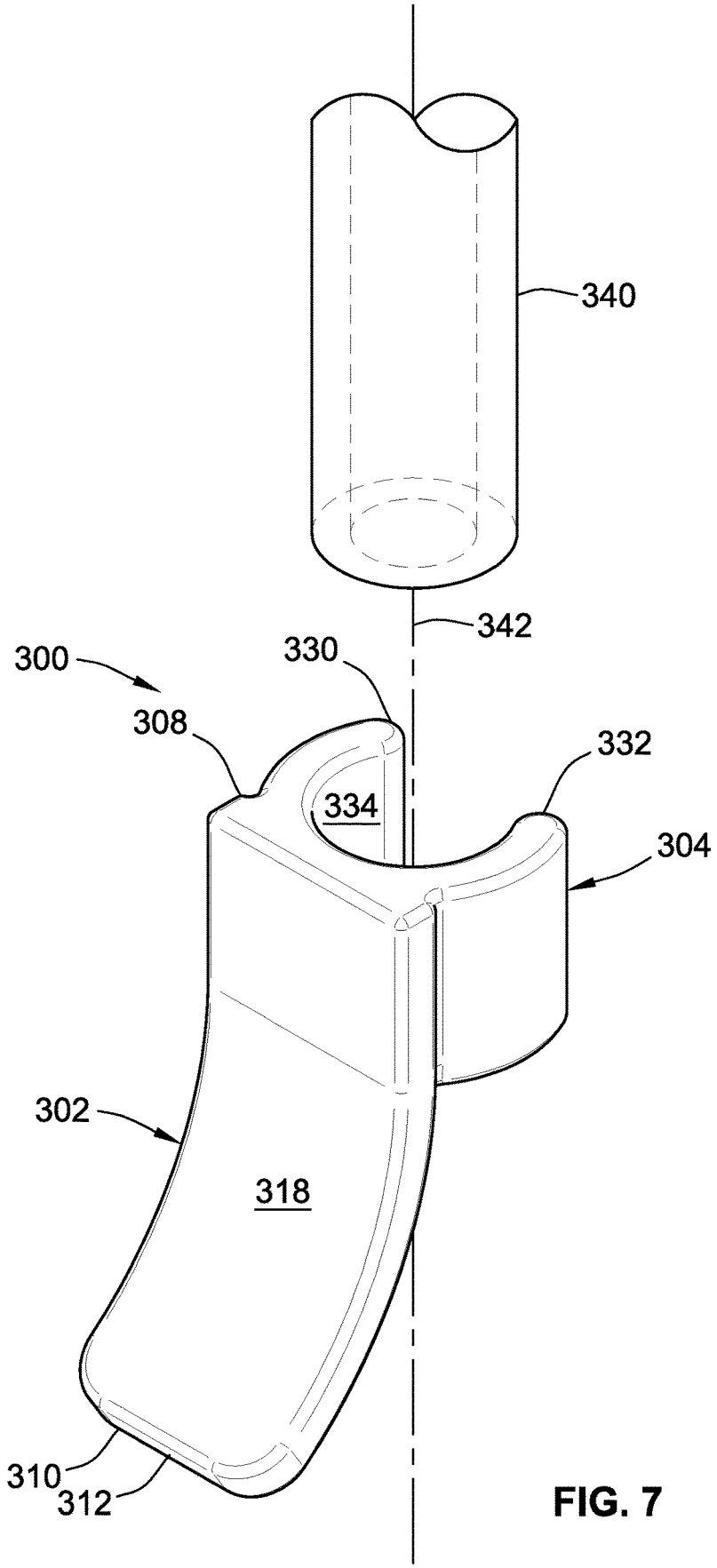
FIG. 7 is a perspective view of a device, in accord with additional aspects of the present disclosure.

With reference to FIG. 7, a device 300 is shown according to additional aspects of the present concepts. The device 300 includes a scoop 302 and a connector 304. The scoop 302 has a proximal end 308 and a distal end 310, with the distal end 310 having a distal tip 312. A scooping surface or face 318 is defined by a portion of the scoop 302 distal to the connector 304. The connector 304 is configured as a clip, such as a pincher clip, with plural arm segments 330, 332 that have an inner surface 334 that defines a volume that is sized and shaped to receive a straw 340. The connector 304 can either rigidly slide up a straw (e.g., straw 130 or 234) or flexibly snap around the straw to secure thereto. The straw 340 fits against the inner surface 334 and the arm segments 330, 332 cooperate with each other to couple the device 300 to the straw 340. A flow path 342 for semi-fluid material traveling through the straw 340 is not blocked by assembly of the device 300 to the straw 340. In an alternative embodiment, the arm segments 330, 332 connect to each other to completely encircle the straw 340.

Figure 8:
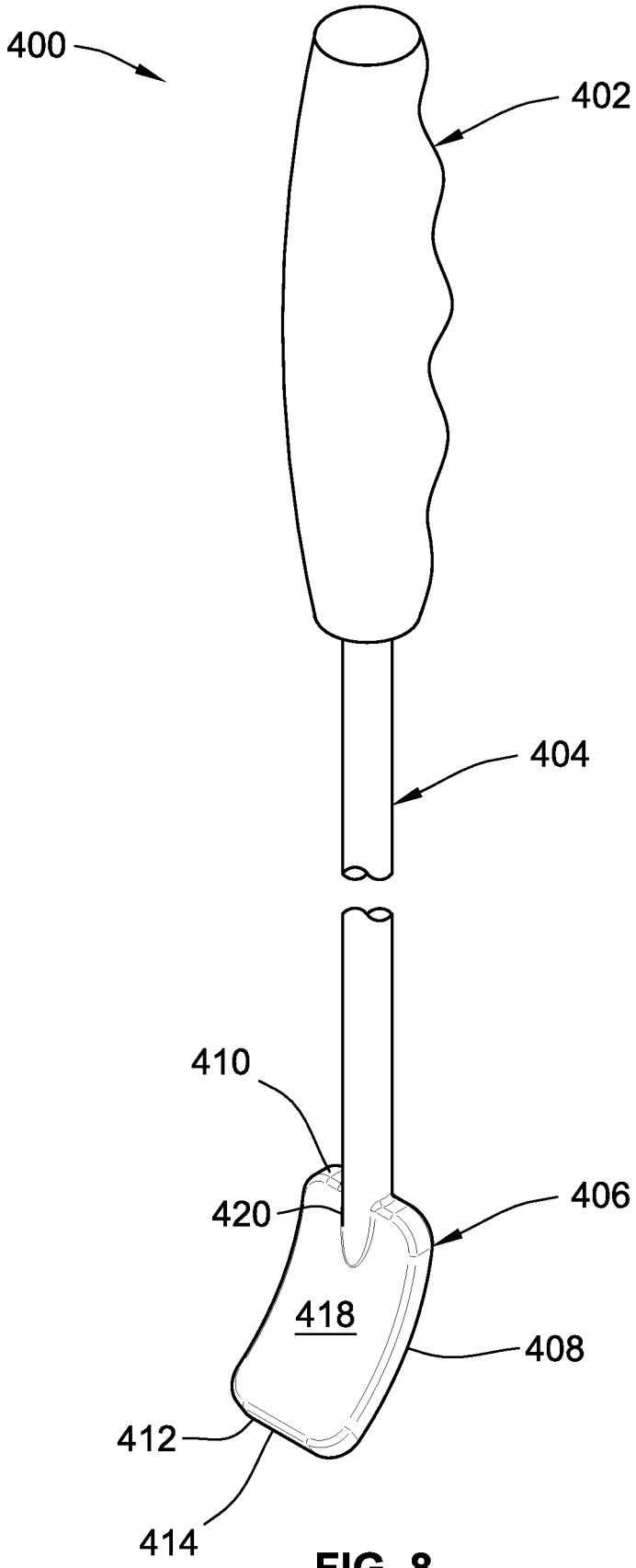
FIG. 8 is a perspective view of a device, in accord with additional aspects of the present disclosure.

In FIG. 8, a perspective view of a device 400 for removing material from a container is shown, in accord with aspects of the present concepts. The device 400 includes a portion similar to the device 100 described above. Specifically, the device 400 includes a handle 402, a shaft or stem 404, and an extractor 406. The extractor 406 can be any one of the devices 100-300 discussed above. For example, the extractor 406 includes a scoop 408. The scoop 408 is curved between a proximal end 410 and a distal end 412 of the extractor 406. A scoop tip 414 is disposed at the distal end 412. A scooping surface 418 is defined by a working surface or face of the extractor 406. A reinforced portion 420 extends outwards from the extractor 406 on the front and the back (not visible in the perspective view). While this embodiment is not designed to couple to a straw or to work operatively with a pump, the gripped handle 402 and sufficiently pliant stem 404 allow for determined amounts of pressure to be applied to the extractor 406 to withdraw semi-fluid material from a container with enough rigidity to maintain the angled orientation of the extractor 406, while flexibly pressing the scoop tip 414 against the inner surface of the container. Because the extractor 406 and the stem 404 are monolithic, the extractor 406 will not be uncoupled from the stem 404 during use and fall into, or remain inside of, the container. Alternatively, the extractor 406 can be formed as a separate piece from the handle 402 and the stem 404. For example, the device 300 may couple to the stem 404, or the stem 404 may include an aperture that allows for coupling of the devices 100 and 200 described above. Alternatively, the stem 404 may be sized to allow for the device 400 to couple to the exterior of the stem 404. Accordingly, a single device (e.g., devices 100-400) can be used both with the handle 402 and stem 404 as part of the device 400, or with a tube of a pump described above. According to some embodiments, the stem 404 may be configured to allow for various different extractors 406 and handles 402 to connect to the stem 404. The stem 404 may have a protuberance or an aperture that allows for mating with corresponding apertures or protuberances of extractors 406 and handles 402.

The handle 402 can have varying lengths according to varying sizes of the stem 404 and/or the extractor 406, According to some embodiments, the handle 402 can be, for example, about 80 to 110 mm long, such as 93 mm. For a length of about 93 mm, the ridges can be, for example, about 10 to 20 mm in height, such as 15 to 16 mm. Between the ridges are valleys. The valleys can be about 5 to 15 mm in height, such as 12 to 13 mm. The ridges and valleys of the handle 402 can correspond to locations where a user's fingers are intended to grip the handle 402.

Although the stem 404 is shown as a single piece with a fixed length, the stem 404 may alternatively be configured to have a variable length. For example, according to one embodiment, the stem 404 can be telescopic such that a user can lengthen or shorten the stem 404 to reach into containers of varying depths. Alternatively, the stem 404 can come in different sizes to accommodate removal of material from containers of different depths. By way of example, and without limitation, the stem 404 can be about 4 to 15 inches long, such as 9 inches. The longer the stem 404, the more versatile the stem 404 is with containers of varying depths. However, a shorter stem 404 may provide for better maneuverability and/or dexterity in manipulating the extractor 406 to remove material within a container.

Although the stem 404 is shown as having a generally circular cross-sectional shape, the stem 404 can have various other cross-sectional shapes, such as oval, rectangular, triangular, etc. According to one embodiment, the cross-sectional shape of the stem 404 can be oval, with a long axis of about 6 to 10 mm, such as 8 mm, and a short axis of about 3 to 6 mm, such as 4 mm.

Although shown as including one extractor 406, alternatively the device 400 can have a second extractor 406 (not shown) extending from the opposite side of the handle 402 as the stem 404. The second extractor 406 can be sized and/or configured differently than the first extractor 406, such as having a different angle and/or width, being in the shape of a spoon, etc. Alternatively, the end of the handle 402 opposite of the stem 404 can include a fixture that allows the device 400 to interface with an object for storage. By way of example, and without limitation, the opposite end of the handle 402 can include a ring or a hole at the end that allows the device 400 to hang from a hook or other similar object for storage. The ring can be various sizes, such as about 20 to 30 mm in diameter, such as 28 mm, in a direction parallel to the axis of the stem 404, and about 2.2 to 26 mm in diameter, such as 24 mm, in a direction, perpendicular to the axis of the stem 404. The aperture formed by the ring for such an embodiment can be, for example, about 10 to 16 mm in diameter, such as about 12 to 14 mm in diameter.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. A structure, limitation, or element that is "configured to" perform a task or operation is particularly structurally formed, constructed, programmed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, programming of the structure or element to perform the corresponding task or operation in a manner that is different from an "off-the-shelf" structure or element that is not programmed to perform the task or operation, and/or denotes structural requirements of any structure, limitation, or element that is described as being "configured to" perform the task or operation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the clauses, or if they include equivalent structural elements with insubstantial differences from the literal languages of the claims.

The invention claimed is:

1. A system for dispensing material comprising:

a container having a bottom, side surfaces, and a mouth, the container being configured to house the material, the container having a corner between the bottom and the side surfaces with a defined radius of curvature;

a pump configured to couple to the mouth of the container;

a tube having a first end connected to the pump and a second end, the tube being configured to provide the material to the pump; and a device connected to the second end of the tube, the device being configured for removing the material from the container, the device having:

a scoop extending distally from a shoulder portion; and a connector extending proximally from the shoulder portion, the connector being configured to couple the device to the tube within the container, the connector including a reinforcing portion that extends distally into the scoop, wherein the connector is a protuberance that is configured to fit within the tube to couple the device to the tube;

wherein a distal tip of the scoop is flat, wherein opposite corners formed between opposite side edges of the scoop and the distal tip of the scoop are curved, and wherein a radius of curvature of the opposite corners matches the defined radius of curvature of the container.

2. The system of claim 1, wherein the protuberance and an inner surface of the tube form a pressure fit.

3. The system of claim 1, wherein the scoop is uniformly curved from the shoulder portion to the distal tip.

4. The system of claim 1, wherein the rigidity of the scoop is less than the rigidity of the container such that the scoop flexes when pressed against the container.

5. The system of claim 1, further comprising a channel extending through the device from a distal tip of the scoop to a proximal tip of the connector such that the distal tip of the scoop and the tube are in fluid communication through the channel.

6. The system of claim 1, wherein a length of the tube and a length of the device are configured such that the device can access material in interior extremities of a lower half of the container.

* * * * *